United States Patent [19]

Flaum et al.

[11] 4,083,095

[45] Apr. 11, 1978

[54] PROCESS FOR CUTTING AND ASSEMBLING MULTIPLE PANELED TOY CONSTRUCTIONS

[76] Inventors: Dennis Michael Flaum, 1 E. Schiller, Chicago, Ill. 60610; Herman Lawrence Fleishman, 6518 N. Kenton, Lincolnwood, Ill. 60645

[21] Appl. No.: 796,757

[22] Filed: May 13, 1977

[51] Int. Cl.[2] ..... B23P 17/00

[52] U.S. Cl. ..... 29/416; 83/29; 83/925 CC; 156/256; 156/264

[58] Field of Search ..... 29/416; 83/23, 27, 29, 83/925 CC; 156/145, 250, 256, 258, 264, 266, 277

[56] References Cited

U.S. PATENT DOCUMENTS

| | | | |
|---|---|---|---|
| 1,839,889 | 1/1932 | Palais | 29/416 |
| 2,260,573 | 10/1941 | Lorch | 83/29 |
| 3,667,332 | 6/1972 | Kirche | 83/925 CC X |

*Primary Examiner*—Victor A. DiPalma
*Attorney, Agent, or Firm*—Alter and Weiss

[57] ABSTRACT

A method for manufacture of bag-like toy constructions assembled from individual vinyl panels. Designs, comprising the artwork on each individual panel, are printed continuously on vinyl sheets in precisely reproducible and spaced sequence. Each vinyl sheet has indexing and registration marks printed along opposed edges. After printing, a plurality of said vinyl sheets are stacked and fastened together in registered alignment. Templates are then utilized to outline each individual panel on the uppermost vinyl sheet. A cutting tool is then used to cut all sheets simultaneously along the template lines. The resulting panels are then seamed together with the printed design face of each panel facing outward, forming a completed toy construction.

10 Claims, 5 Drawing Figures

PROCESS FOR CUTTING AND ASSEMBLING MULTIPLE PANELED TOY CONSTRUCTIONS

This invention relates to a method for assembling baglike toy constructions. More particularly, the present invention provides a method whereby individual panel designs for panelized toy constructions may be printed on continuous sheets, the sheets thereafter stacked in precise vertical alignment and a standard cutting tool used to cut a plurality of such panels simultaneously.

A type of toy construction becoming increasingly more popular is the so-called "beanbag" toy, wherein a soft vinyl outer shell is stuffed with plastic "beans" and thereafter mounted to a specialized chassis, such as a base having wheels or a rocking chair base to provide a soft, safe attractive toy. Beanbags of the type herein discussed are assembled from individual panels, most commonly of a cloth or vinyl/cloth combination. Such panels are seamed together, stuffing is placed therewithin, and the bag is then sealed and ready for use as a toy, cushion, chair, or the like.

In many such constructions, the outer surface of the fabric or vinyl material used to construct the beanbag is of a single color or texture; the individual panels used to manufacture such bags must be cut accurately as to size and shape, and may be cut in multiple sheets stacked one upon the other similar to the manner in which cloth for garments is cut. Cutting of individual panels is made much more difficult when a printed design appears on each panel. Such cutting must then be carried out with a high degree of accuracy in order to ensure that the designs so printed are correctly and uniformly aligned and oriented on each panel when the cutting of the panels is completed. If the sheets to be cut are not stacked to bring the designs printed thereon into exact register, the resulting panels may omit parts of designs or may have said designs misaligned thereon, resulting in an unattractive finished product of poor quality. Thus, successful mass production of beanbag toys requires all panels to be uniform in size, shape, and in position thereon of the design to appear on each panel. Accordingly, the present invention has the following objects:

To provide means for stacking and cutting multiple sheets with designs printed thereon, to produce individual panels with said designs uniformly and properly positioned thereon;

To provide such methods whereby multiply stacked sheets of material may be cut simultaneously;

To provide such methods whereby panels assemblable into beanbag constructions may be cut with a minimum of material waste;

To provide such methods using precisely printed and alignable webs of vinyl material upon which designs are printed and from which the beanbag panels are cut;

To provide such methods utilizable with standard material cutting implements; and To provide such webs with indexing means assuring horizontal and vertical alignment.

These and further objects will become more apparent upon consideration of the accompanying drawings in which.

Figure 1:
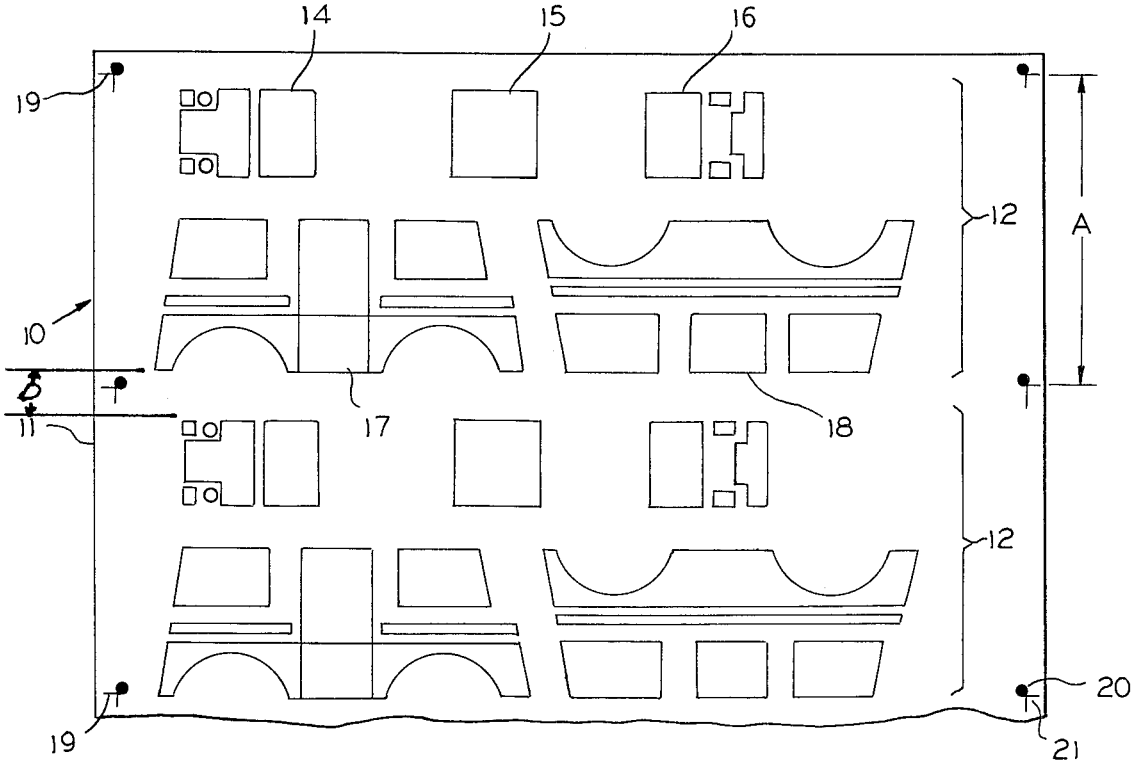
FIG. 1 is a partial plan view of a printed vinyl web.

Consistent with the foregoing objects, a method for manufacturing multiples of a family of panels is provided, wherein vinyl web 11 has designs 12 printed thereon at accurate intervals D, and index marks 19 printed along opposed edges thereof. Web 11 is then severed to form segments, which are stacked to register designs 12. Templates, as at 26, are used to outline the individual panels, as at 27, on the uppermost segment, and cutter 28 is then used to cut stacked segments 22 to form multiples of the family of panels needed to construct toy bus 13.

Referring now to FIG. 1, the numeral 10 indicates generally a portion of a vinyl web 11 having designs 12 imprinted thereon. In this selected embodiment, the beanbag toy to be produced is a stuffed toy bus 13 shown fully assembled in FIG. 5. The individual design elements included in each design 12 comprise front grill and windshield 14, roof window 15, rear window and bumper 16, left body side 17 and right body side 18. As is evident, design 12 may be reprinted sequentially on as long a web 11 as is practicable and may be furnished to the manufacturing facility in roll form, providing ease and shipment and in storage prior to manufacture.

Designs 12 are uniformly centered on web 11 and are printed a precise distance D apart. This spacing makes it possible to overlay segments of web 11 to bring designs 12 into vertical register with one another. Cutting of one panel from the uppermost web segment would then produce a plurality of such panels having the same portion of design 12 similarly oriented and aligned thereon.

Along each lengthwise edge of web 11 are printed index marks 19. In order to make multiple cutting of panels 14 through 18 practicable, web 11 must be vertically stackable with other similar webs to bring patterns 12 into horizontal alignment. Index marks 19 are printed along opposed edges of web 10 to insure such horizontal alignment. As shown in this embodiment, index marks 19 are printed a uniform distance A apart, with a complete design 12 positioned within successive pairs of index marks 19.

The material most commonly used to assemble beanbags comprises an upper vinyl layer to which is bonded a lower reinforcing cloth layer; this resulting construction is somewhat translucent. In this embodiment, indexes 19 are printed in heavy black ink and include a location dot 20 and a pair of lines 21 meeting at right angles, thus visible through web 11 when held up to a source of light.

Figure 2:
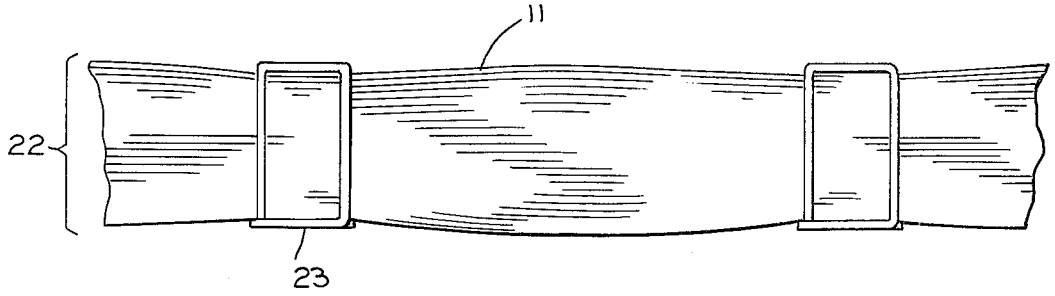
FIG. 2 is a side view of a plurality of web segments stacked and fastened together.

Web 11 may then be stacked in horizontal alignment with other such webs by the expedient of sighting and aligning indexes 19 on successively stacked translucent webs. When a desired number of webs has been thus stacked as shown at 22 of FIG. 2 the resulting stack may be temporarily fastened together in horizontal and vertical alignment by staples 23 or other similar fasteners/ Aligning index marks 19 thus registers designs 12 on stacked web segments 22.

Figure 3:
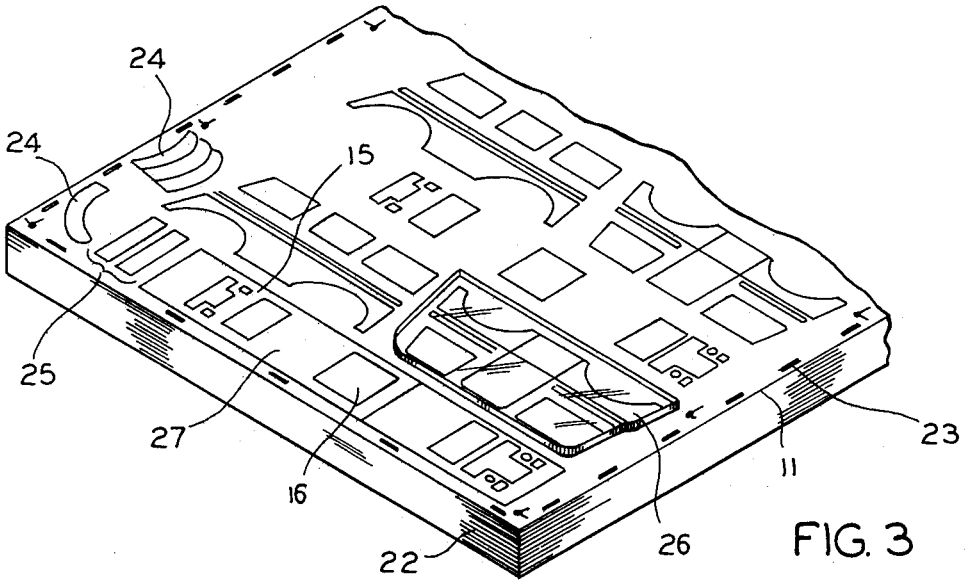
FIG. 3 is a perspective view of the webs of FIG. 2 illustrating use of a template.
Figure 5:
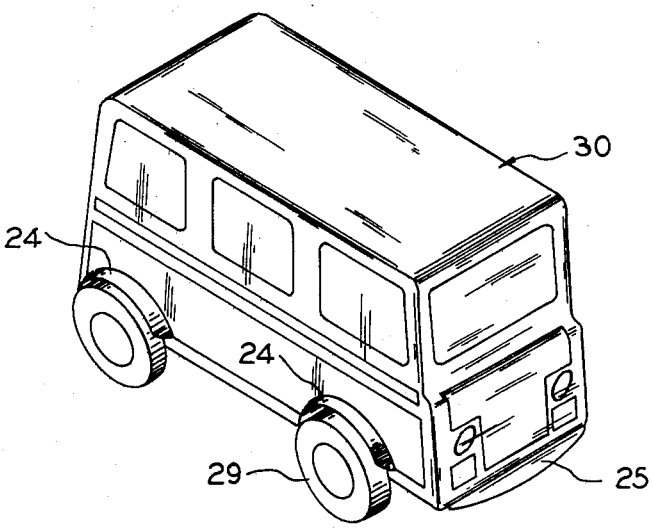
FIG. 5 is a perspective view of a completed beanbag toy bus.

Stack 22, as shown in FIG. 3, is then prepared for actual cutting. While panel design elements 14 through 18 have been printed on web 11 in selected colors, the most efficient use of material results when other panels or components of the finished beanbag 13, of the same color as the vinyl upper layer of web 11 are cut from web 11. As an example, parts such as fenders 24 and bumpers 25, as shown in FIG. 5, may be separately printed or drawn on web 11 and thereafter cut out to be assembled. As an additional example, it is noted that often, separate printed panel designs may be spaced to be combined onto a single cut panel to simplify construction of the final beanbag.

Examples of each of these techniques are illustrated at FIG. 3. Separate clear plastic templates, such as that illustrated at 26, are placed over printed design elements 14–18 and each panel is outlined, as in black ink, to serve as a cutting guide. A separate template is used for each panel. Additional elements such as fenders 24 and bumpers 25 may be included on web 11 wherever convenient to assure as little wasted material as is possible. As further shown at FIG. 3, printed design elements 15 and 16 may be combined onto a single panel 27 by use of an appropriate template.

Figure 4:
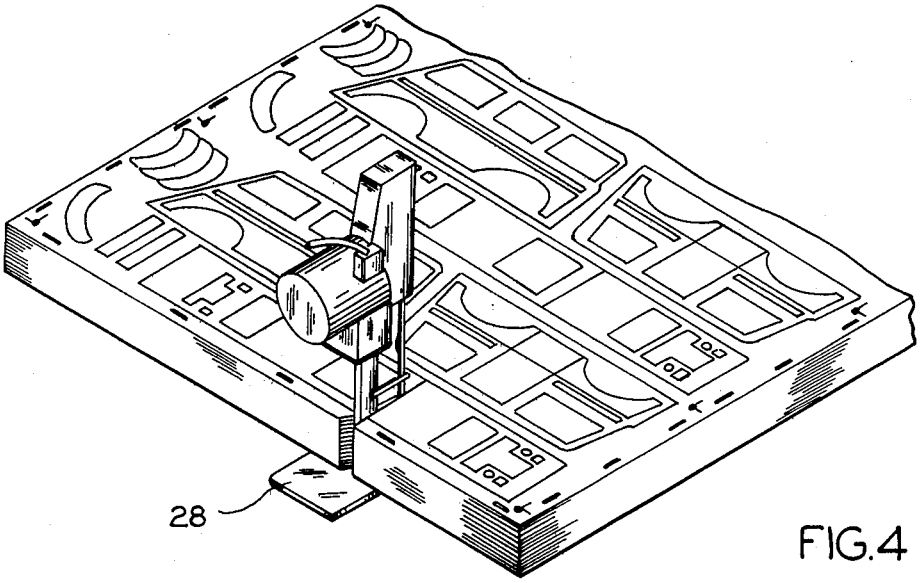
FIG. 4 shows the webs of FIG. 3 during the cutting process.

Once the individual panel sections have been templated, as illustrated in FIG. 4, cutting may proceed. The cutting devices used are capable of severing many webs cleanly and simultaneously; up to twenty such layers have been successfully cut. The resulting panels are then seamed together, stuffed, and, in this embodiment, assembled onto a truck chassis 29 to produce a beanbag truck toy 13. In this particular embodiment, the bottom panel (not shown) of truck 13 is assembled from a different piece of material on a different web, primarily to facilitate the fastening thereto of a zipper or closure mechanism. It is to be understood however that such a bottom panel may be easily and conveniently included in the printed design 12 on web 11.

In this manner, it can be readily seen that preparation and cutting of such panels in large lots is made possible, thereby enabling a single operator to produce a large quantity of such panels cheaply and quickly. The uppermost web 11 of stack 22 may be templated and used as a guide for the remainder of the stacked webs, with the designs printed thereon appearing correctly registered on each individual panel section.

While the foregoing has presented a particular embodiment of the invention, it is to be understood that this embodiment is presented by way of example only. It is expected that others skilled in the art will perceive variations which, while differing from the foregoing, do not depart from the spirit and scope of the invention as herein described and claimed.

I claim:

1. A method for manufacturing multiples of a family of panels from segments of vinyl web stock, said family including panels for forming a bag structure, said panels including designs printed on said stock, said families produced with corresponding of said designs positioned on corresponding of said panels, said method comprising the steps of:

(a) imprinting said designs on said web at accurately reproducible intervals;

(b) indexing said web by printing index marks along opposed edges of said web to correspond to said intervals;

(c) severing said web to form said segments;

(d) stacking said segments to bring said designs on adjacent of said segments into register by overlaying said index markings on said adjacent segments;

(e) templating each panel of said family on the uppermost of said segments to form an outline of each said panel, said outline including therewithin that portion of said design to be reproduced on each side panel; and (f) cutting through said stacked segments along said outline of each said panel to form said multiples of said family.

2. The method as recited in claim 1 including the step of:

(g) assembling said families to form said bag structures.

3. The method as recited in claim 1 including the step of:

binding said segments together prior to said cutting.

4. The method as recited in claim 3 wherein said binding is accomplished by stapling.

5. The method as recited in claim 1 wherein:

each said family includes panels to form a top, front, back, left side, and right side of said bag structure.

6. A method for manufacturing multiples of a family of panels to produce three dimensional bag structures, each said panel having a design imprinted thereon, said method comprising the steps of:

(a) imprinting designs on a continuous web of vinyl material at accurately reproducible intervals;

(b) indexing said web by printing index marks thereon along opposed edges of said web to correspond to said intervals;

(c) severing said web to form segments of near equal size, each said segment including an intergral multiple of said designs;

(d) stacking said segments to bring said designs on adjacent of said segments into vertical alignment by overlaying said index markings of said adjacent segments;

(e) using a template to outline each panel of said family on the uppermost of said segments, each said panel outline including that portion of said designs to appear on each said panel;

(f) cutting along said outline of each said panel to form said multiples of said family from said stacked segments; and (g) assembling the panels from each said family so formed to complete said bag structures.

7. The method as recited in claim 6 including the step of:

stapling said segments together to maintain said alignment prior to said cutting.

8. The method as recited in claim 6 including the step of:

including with said designs, representations of the front, top, rear, left side, and right side of a vehicle to be respectively positioned on front, top, rear, left side, and right side panels of said bag structures.

9. The method as recited in claim 6 further including the step of:

lining additional elements to be attached to said bag structures on said uppermost segment, prior to said cutting, said elements having no additional design printed thereon.

10. The method as recited in claim 9 wherein said additional elements are representations of vehicle fenders and bumpers.

* * * * *

UNITED STATES PATENT AND TRADEMARK OFFICE

CERTIFICATE OF CORRECTION

PATENT NO. : 4,083,095

DATED : April 11, 1978

INVENTOR(S) : Dennis Michael Flaum and Herman Lawrence Fleishman

It is certified that error appears in the above-identified patent and that said Letters Patent are hereby corrected as shown below:

Col. 4, line 5: "side" should be --said--.

Signed and Sealed this

*Third* Day of *October 1978*

[SEAL]

*Attest:*

RUTH C. MASON
*Attesting Officer*

DONALD W. BANNER
*Commissioner of Patents and Trademarks*